US011643785B2

(12) United States Patent
Zhou et al.

(10) Patent No.: US 11,643,785 B2
(45) Date of Patent: May 9, 2023

(54) TIE DOWN GROUND ANCHOR HEAD

(71) Applicants: Wei Zhou, Bristol, IN (US); Alivia Faye Zhou, New York, NY (US)

(72) Inventors: Wei Zhou, Bristol, IN (US); Alivia Faye Zhou, New York, NY (US)

( * ) Notice: Subject to any disclaimer, the term of this patent is extended or adjusted under 35 U.S.C. 154(b) by 93 days.

(21) Appl. No.: 17/033,152

(22) Filed: Sep. 25, 2020

(65) Prior Publication Data

US 2022/0098815 A1 Mar. 31, 2022

(51) Int. Cl.
*E02D 5/80* (2006.01)
*E04H 12/22* (2006.01)
*E04B 1/343* (2006.01)

(52) U.S. Cl.
CPC ..... *E02D 5/801* (2013.01); *E04B 1/34347* (2013.01); *E04H 12/2223* (2013.01); *E02D 2200/1671* (2013.01)

(58) Field of Classification Search
CPC ..... E04B 1/34347; E02D 5/80; E02D 5/801; E02D 2200/1671; E04H 12/2223
See application file for complete search history.

(56) References Cited

U.S. PATENT DOCUMENTS 3,645,055 A * 2/1972 Roza ..... E02D 5/801 52/157
3,793,786 A * 2/1974 Jahnke ..... E02D 5/801 52/157
4,334,392 A * 6/1982 Dziedzic ..... E02D 5/801 52/157
5,457,918 A * 10/1995 Plourde ..... E04H 12/2223 52/165
6,263,622 B1 * 7/2001 Griffin ..... E02D 5/801 52/156
6,963,026 B2 * 11/2005 Brennan ..... H01R 4/66 81/177.85
9,464,397 B1 * 10/2016 Abraham ..... E02D 5/801
9,869,177 B2 * 1/2018 Meline ..... E21D 20/025
10,077,893 B1 * 9/2018 Abraham ..... F16B 7/105
(Continued)

FOREIGN PATENT DOCUMENTS

CA 2278074 A1 * 1/2000 ..... E02D 5/74
DE 20017386 U1 * 12/2000 ..... E04H 12/2223
(Continued)

*Primary Examiner* — Jessie T Fonseca
(74) *Attorney, Agent, or Firm* — Crump Law P.C.

(57) ABSTRACT

An anchor head mounted to or incorporated into the shaft of conventional tie down stakes and earth anchors. The anchor head eliminates the need to manually drive the earth anchor into the ground and allows the anchor to be placed and removed using conventional powered drill/drivers and hex sockets or wrenches. The anchor head has a hexagonal top section and a hexagonal bottom sectional separated by an integral, central annular shoulder. The top and bottom sections are each configured to have six equilateral side walls and dimensioned to receive two different sizes of wrench or hex socket. The bottom section of the anchor head has a threaded axial bore for receiving the threaded end of the anchor shaft. The bottom section also has a lateral "swage" bore through which a punch is inserted to swage or deform the threads of the shaft to permanently secure the anchor head to the shaft.

6 Claims, 9 Drawing Sheets

(56) References Cited

U.S. PATENT DOCUMENTS

| | | | | |
|---|---|---|---|---|
| 10,352,014 | B1 * | 7/2019 | Baptiste | A01K 1/04 |
| 10,889,953 | B1 * | 1/2021 | Buse | E04G 17/02 |
| D911,132 | S * | 2/2021 | Zhou | D8/388 |
| 2004/0163336 | A1 * | 8/2004 | Hsu | E04H 12/2223 52/157 |
| 2015/0013620 | A1 * | 1/2015 | Royals | A01K 1/04 119/786 |
| 2015/0114053 | A1 * | 4/2015 | Staller | E02D 1/00 52/165 |

FOREIGN PATENT DOCUMENTS

| | | | | |
|---|---|---|---|---|
| DE | 202006012785 | U1 * | 1/2007 | E02D 5/801 |
| GB | 2381278 | A * | 4/2003 | E04H 12/2223 |
| GB | 2426012 | A * | 11/2006 | E02D 5/801 |
| KR | 101467142 | B1 * | 12/2014 | |
| WO | WO-2009075595 | A2 * | 6/2009 | E01F 9/635 |
| WO | WO-2012123576 | A1 * | 9/2012 | E02D 5/801 |

* cited by examiner

TIE DOWN GROUND ANCHOR HEAD

This invention relates to tie down ground stakes and anchors, and in particular an anchor head for allowing power drivers and tools to be used to place the anchors in the ground.

BACKGROUND AND SUMMARY OF THE INVENTION

Tie down stakes and earth anchors are used in a variety of applications from tethering pets, securing tents and anchoring structures. Spiral style anchors have a spiral shaft that is turned into the ground. Blade style anchors have a straight shaft and a helical end blade that turns into the ground. The shafts of both spiral and helical blades terminate in a handle, which is used to manually turn the anchors into the ground. Manually placing the anchors into the ground can be difficult and time consuming depending on the type and condition of the soil.

The present invention provides an anchor head that is mounted to or incorporated into the shaft of conventional tie down stakes and anchors. The anchor head eliminates the need to manually drive the anchor into the ground and allows the anchor to be place and removed using conventional powered drill/drivers and hex sockets or wrenches. The anchor head has a hexagonal top section and a hexagonal bottom sectional separated by an integral, central annular shoulder. The top and bottom sections are each configured to have six equilateral side walls and dimensioned to receive two different sizes of wrench or hex socket. The bottom section of the anchor head has a threaded axial bore for receiving the threaded end of the anchor shaft. The bottom section also has a lateral "swage" bore" through which a punch is inserted to swage or deform the threads of the shaft to permanently secure the anchor head to the shaft.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention.

The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
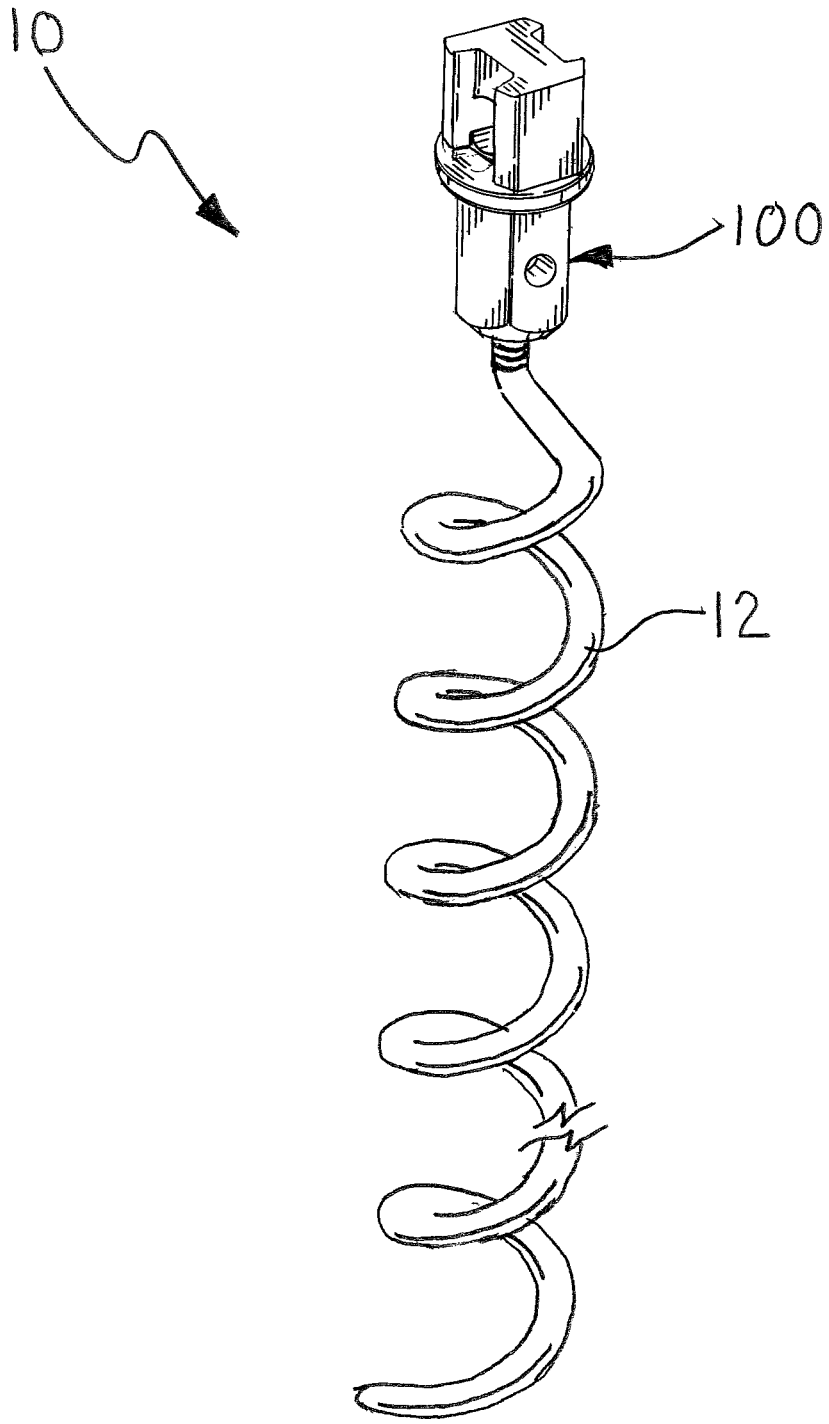
FIG. 1 is a perspective view of an exemplary embodiment of the anchor head of this invention mounted to a spiral tie down ground anchor.
Figure 3:
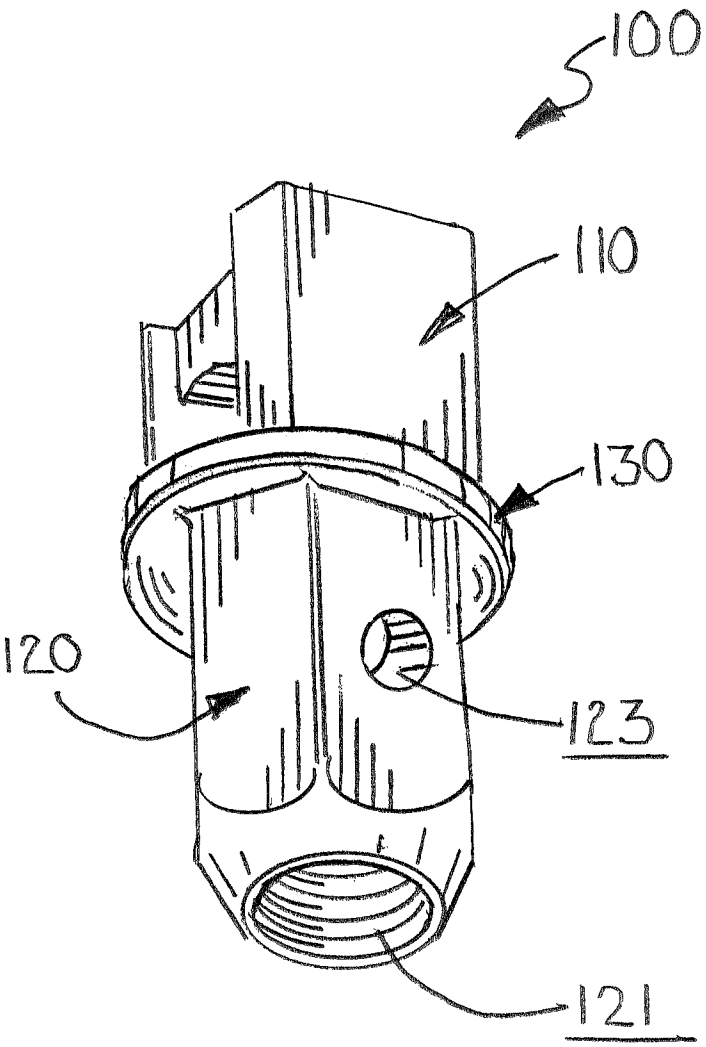
FIG. 3 is a bottom perspective view of the anchor head of FIG. 1.
Figure 2:
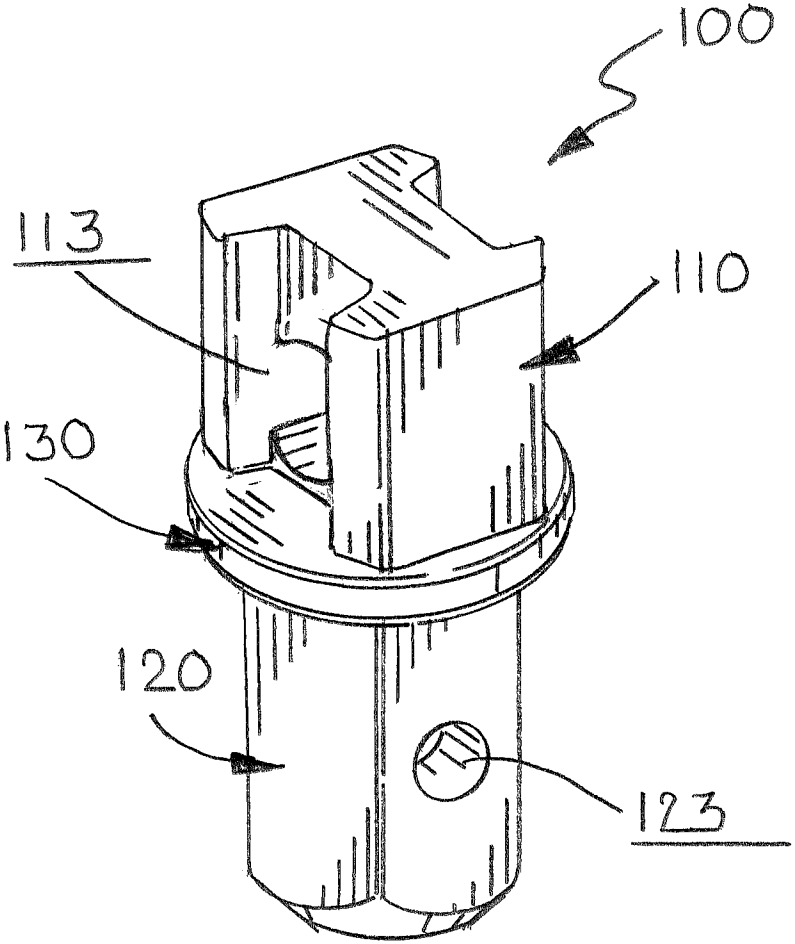
FIG. 2 is a top perspective view of the anchor head of FIG. 1.
Figure 4:
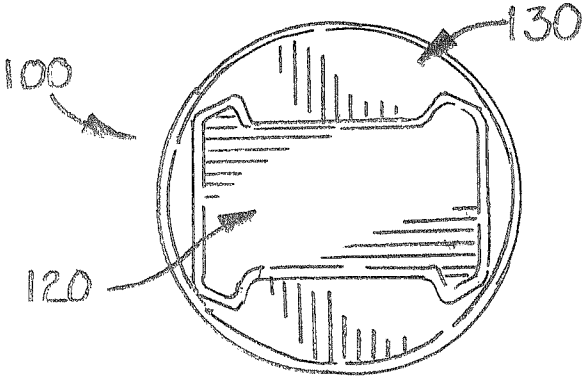
FIG. 4 is a top view of the anchor head of FIG. 1.
Figure 6:
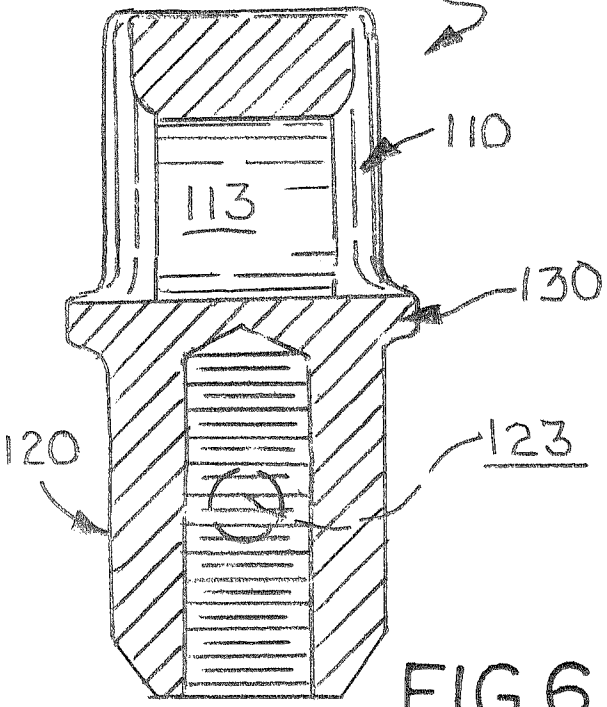
FIG. 6 is a side sectional view of the anchor head of FIG. 1.
Figure 5:
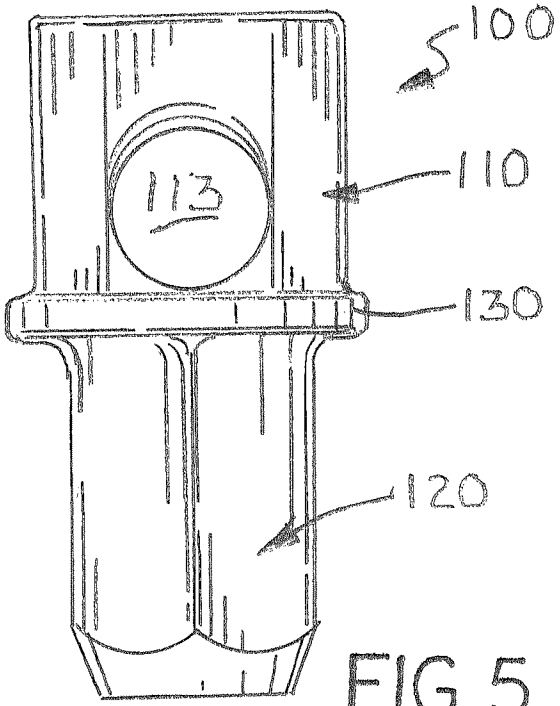
FIG. 5 is a side view of the anchor head of FIG. 1.
Figure 7:
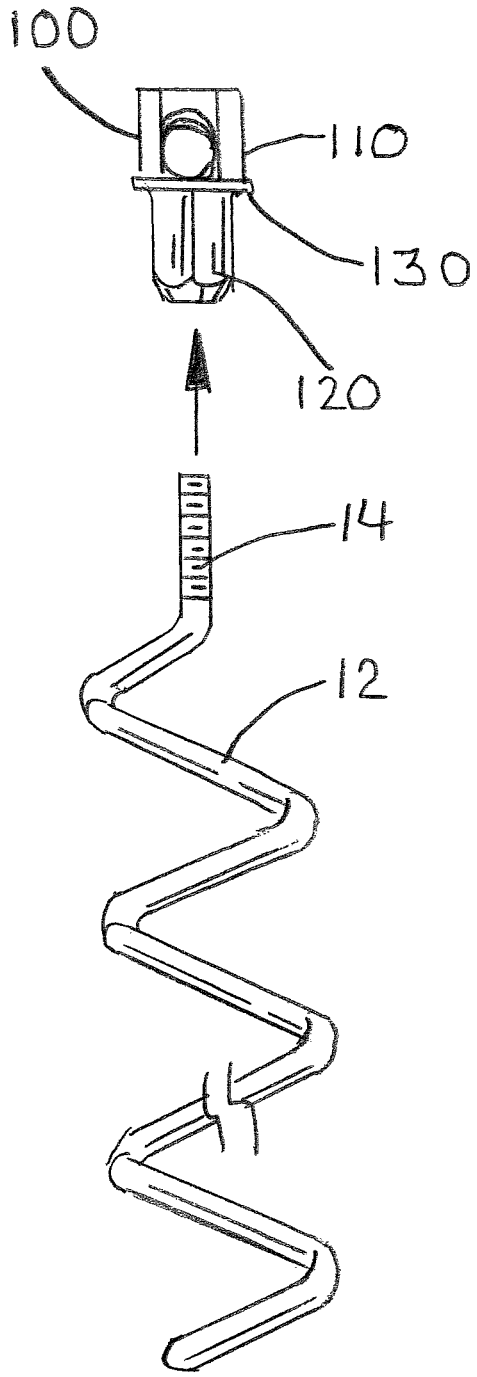
FIG. 7 is an exploded side view of the anchor head and spiral shaft of FIG. 1.
Figure 8:
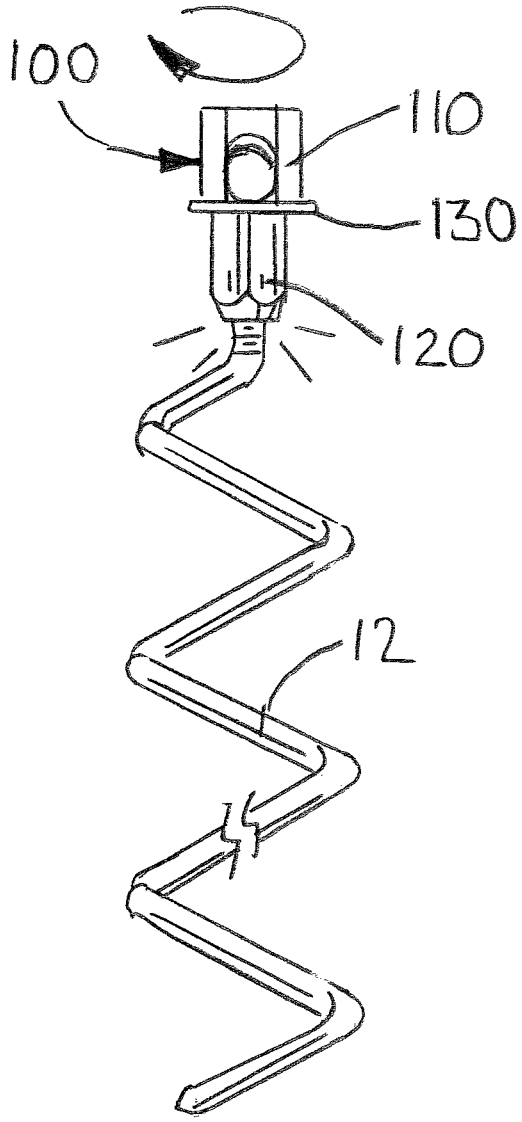
FIG. 8 is a side view of the anchor head mounting to the spiral shaft of FIG. 1.
Figure 9:
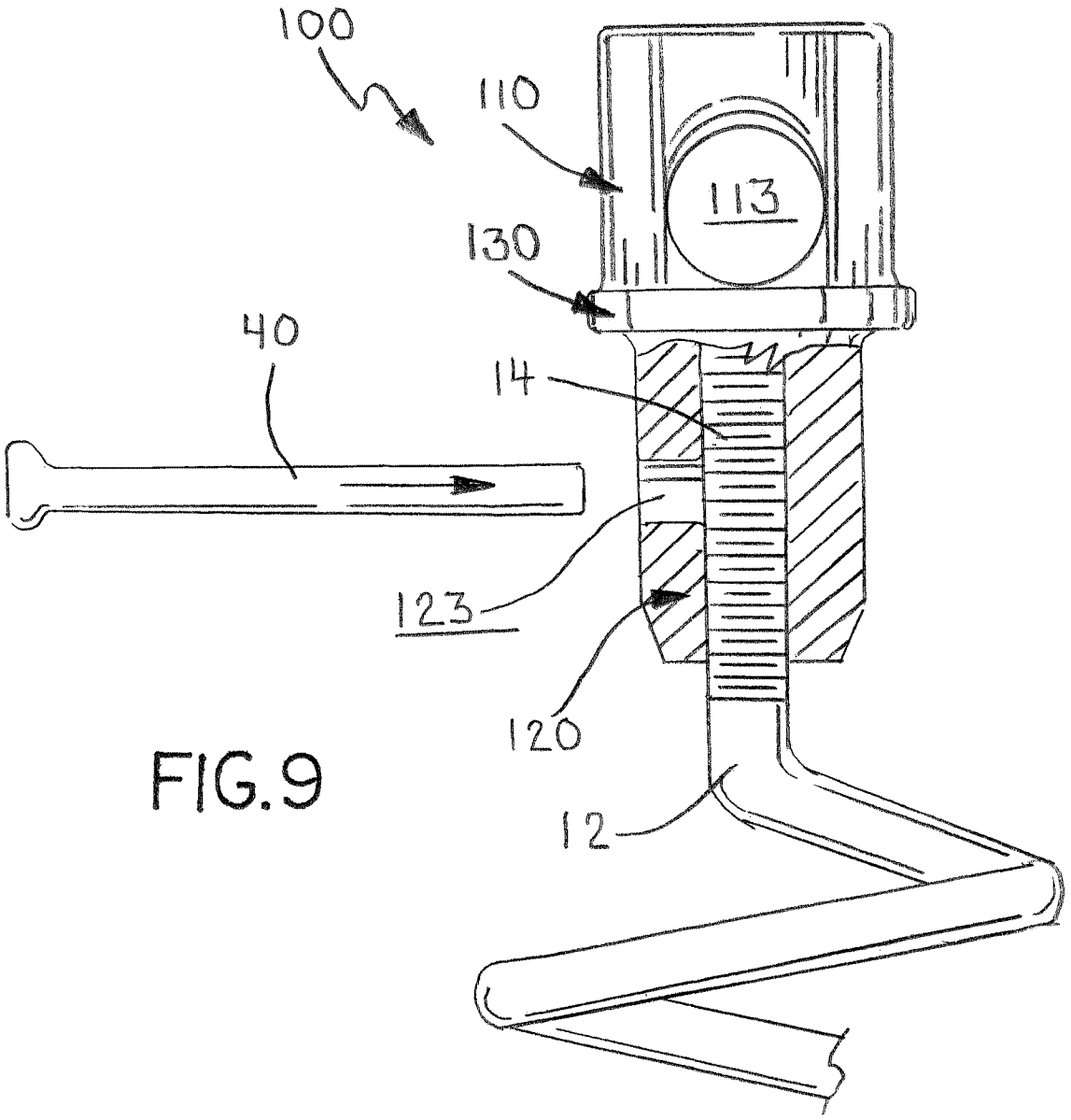
FIG. 9 is a partial side sectional view of the anchor head and spiral shaft of FIG. 1 and a punch.
Figure 10:
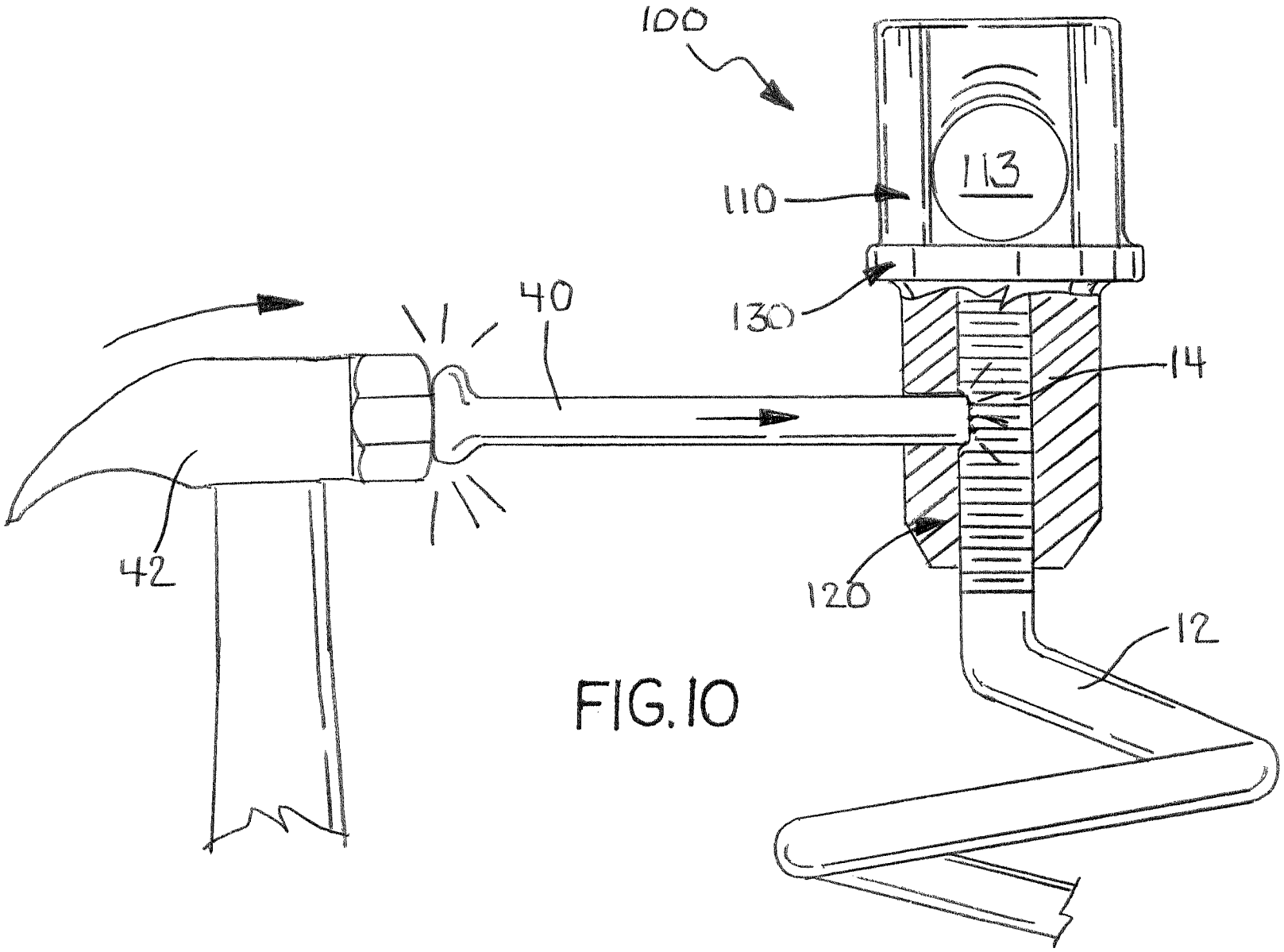
FIG. 10 is a side view of the anchor head mounting to the spiral shaft of FIG. 1 being permanently affixed using a punch and hammer.

Referring now to the drawings, FIGS. 1-16 illustrate an embodiment of the tie down anchor head of this invention, which is designated generally as reference numeral 100. In FIG. 1, anchor head 100 is part of a spiral style tie down ground anchor 10. Anchor 10 has a spiral shaft 12 terminating in a threaded end 14. In other embodiments, anchor head 100 is fitted to other styles of tie down ground anchors having shafts that are turned into the ground.

Figure 16:
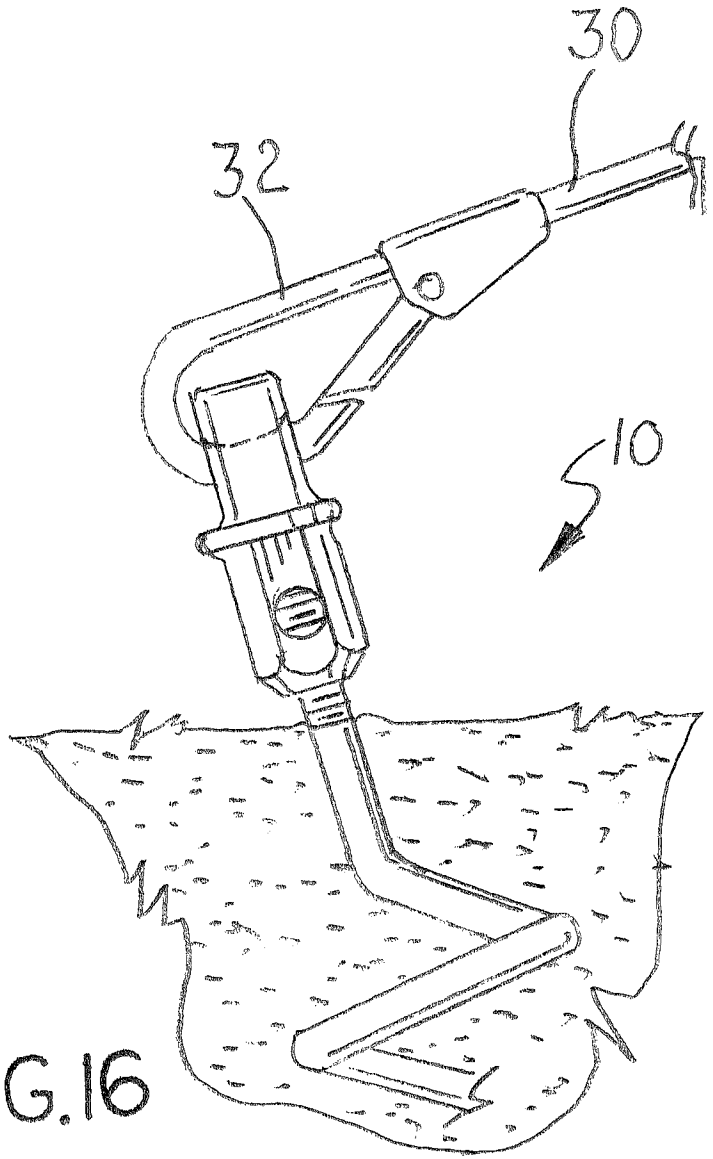
FIG. 16 is a side view of the anchor of FIG. 1 and another guide wire.

Anchor head 100 has a cast or machined metal body. Generally, anchor head 100 is fashioned from a suitable metal, such as a steel or aluminum alloy, but in certain embodiments the anchor head may be formed from a suitable polymer plastic. As shown, anchor head 100 has a hexagonal top section 110 and a hexagonal bottom sectional 120 separated by an integral, central annular shoulder 130. Top sections 110 and bottom 120 are each configured to have hexagonal (six) equilateral side walls and dimensioned to received a standard wrench or socket driver. Typically, section 110 is dimensioned to receive a 1" wrench or drive socket (not shown) and section 120 is dimensioned to fit a conventional ⅝" wrench (not shown). In alternative embodiments, sections 110 and 120 can be configured and dimensioned to receive any style or size of wrench or socket. Top section 110 has a lateral through bore 111, which provides an opening for receiving a guide line (FIG. 15) or tether coupling (FIG. 16). Section 120 has a threaded axial bore 121 for receiving the threaded end of shaft 12 or 22. Section 120 also has a lateral swage bore 123 extending through one side wall into bore 121. Swage bore 123 provides an opening for receiving a punch tool. As shown, anchor head 100 is turned onto threaded end 14 of shaft 12 and is secured by swaging, i.e., "deforming" the threads of the shaft. A punch is inserted into swage bore 123 and struck with a hammer or mallet to impact and deform the threads of the anchor shaft. Swaging the threads of shaft 12 prevents anchor head 100 from rotating off the shaft. In other embodiments of the anchor head, bore 123 may be threaded to receive a set screw (not shown) that engages the thread shaft to prevent the anchor head from rotating about the shaft.

Figure 11:
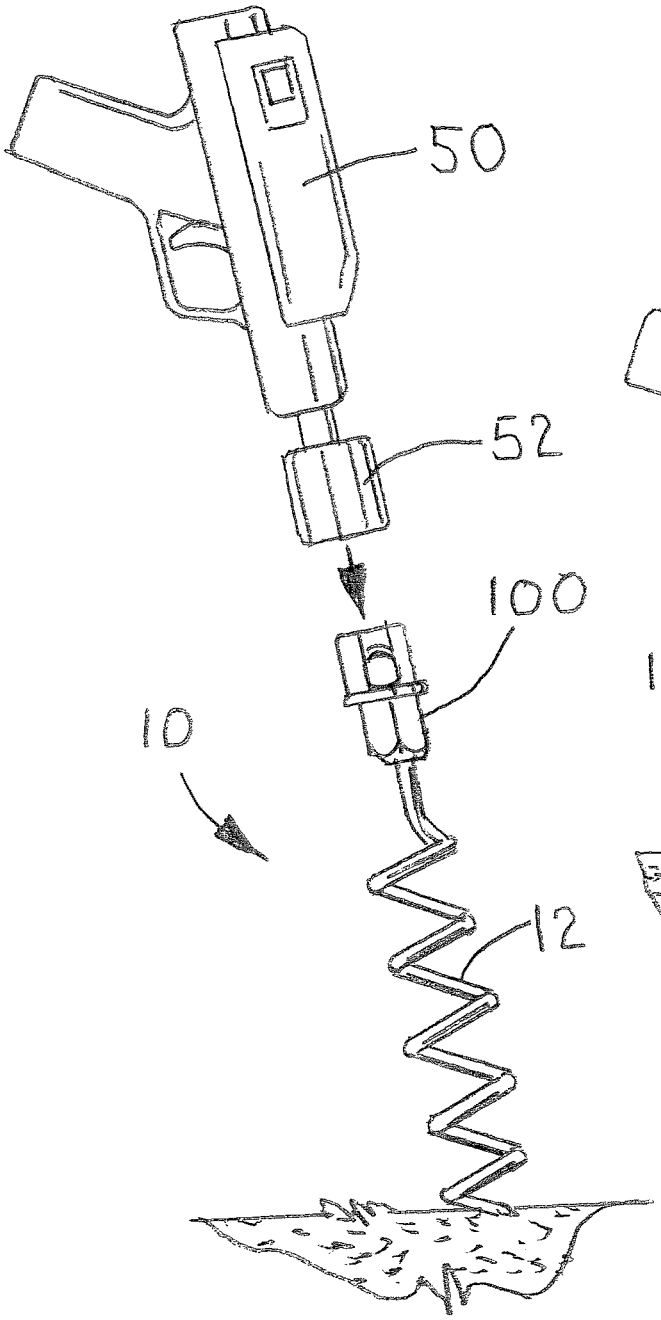
FIG. 11 is a side view of a power drill/driver and socket driving the anchor of FIG. 1.
Figure 12:
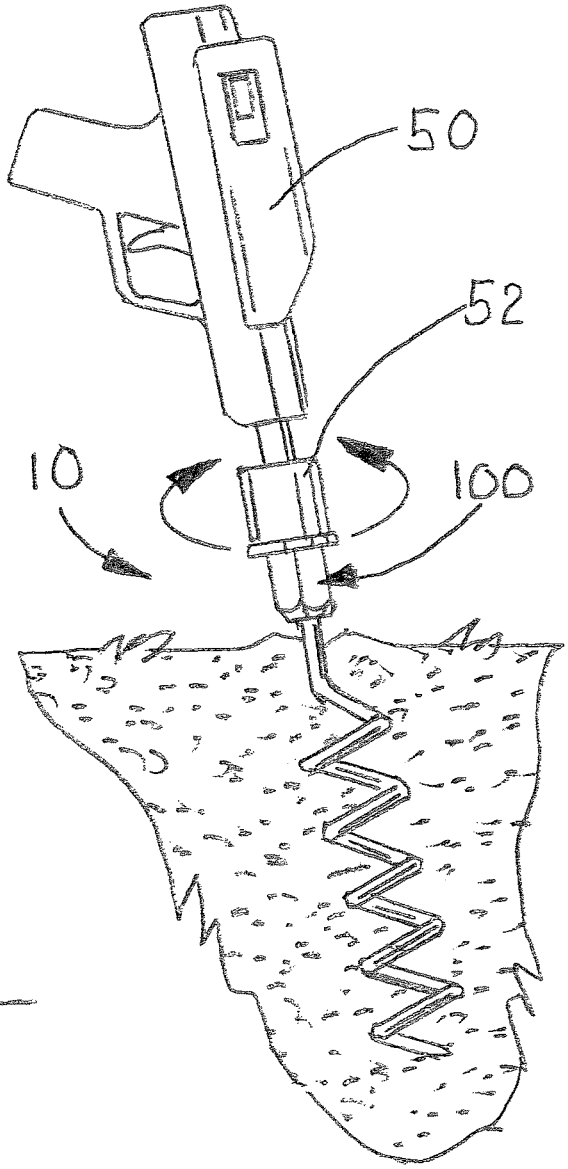
FIG. 12 is a side view of a power drill/driver and socket driving the anchor of FIG. 1 into the ground.
Figure 14:
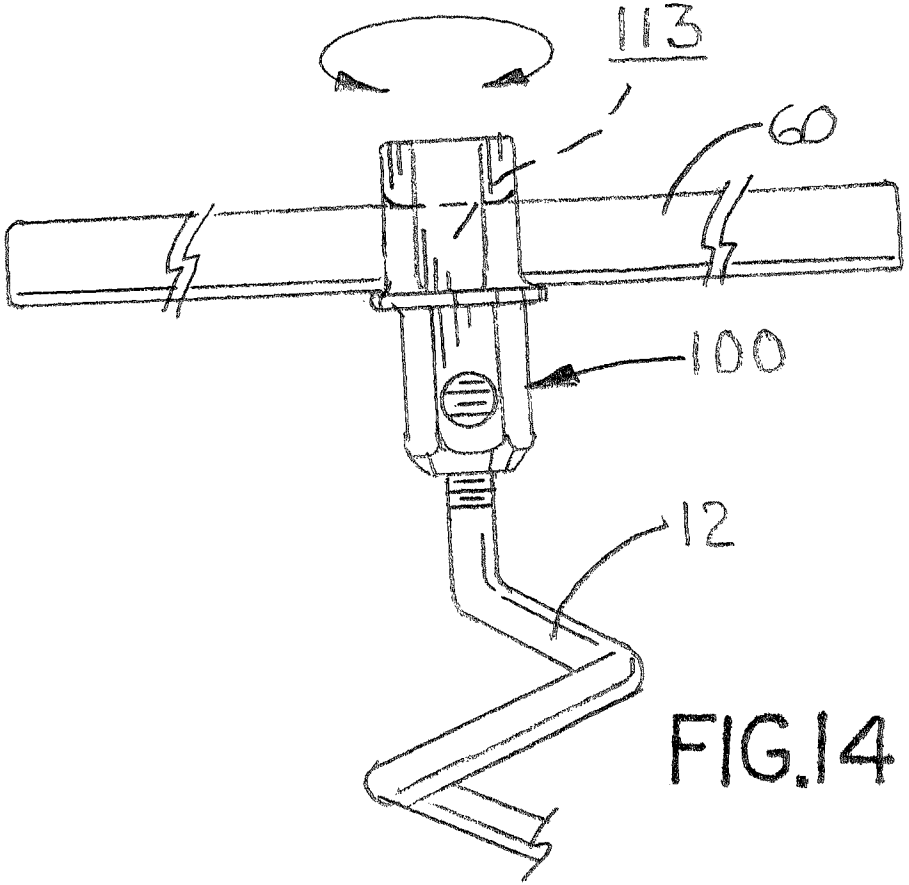
FIG. 14 is another partial side view of a pry bar and the anchor of FIG. 1.
Figure 13:
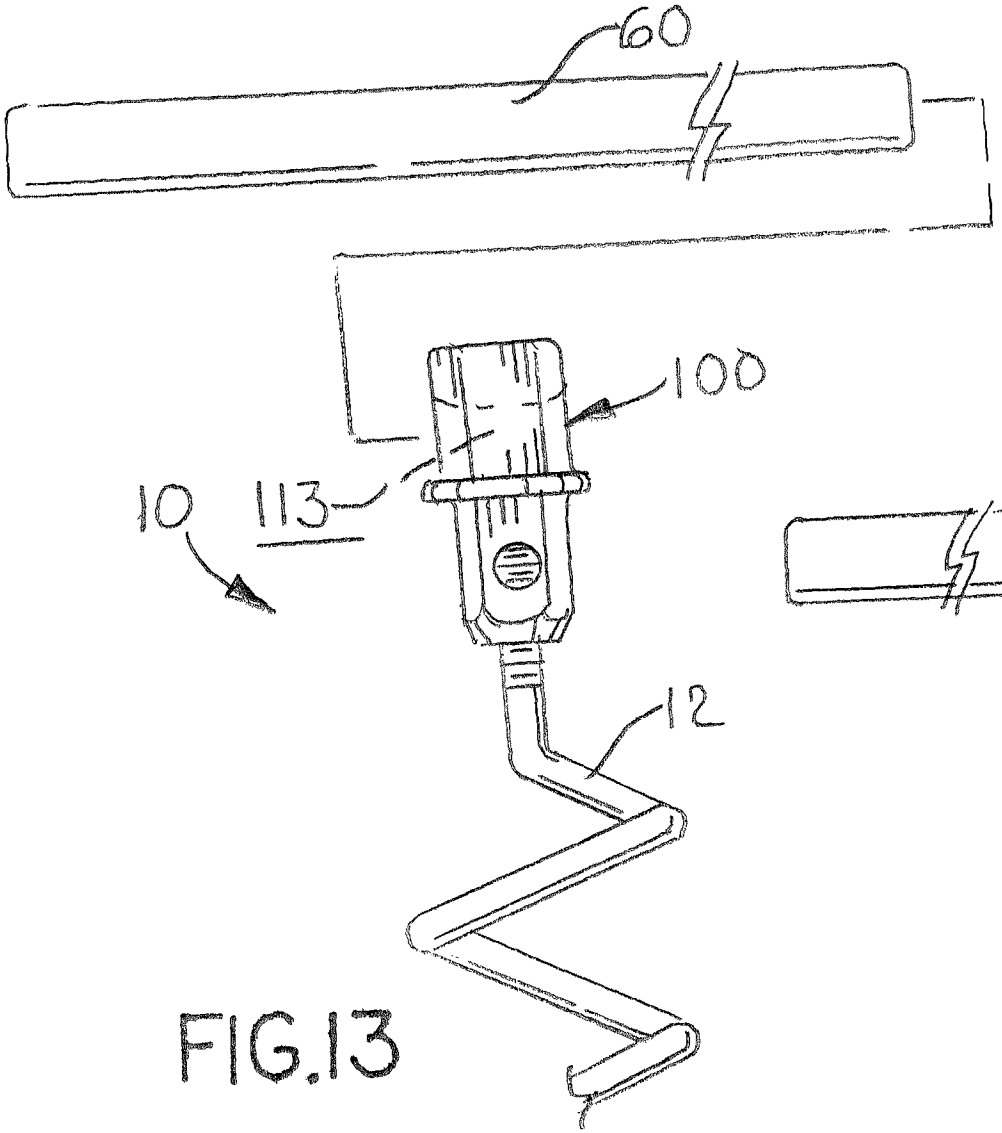
FIG. 13 is a partial side view of a pry bar and the anchor of FIG. 1.
Figure 15:
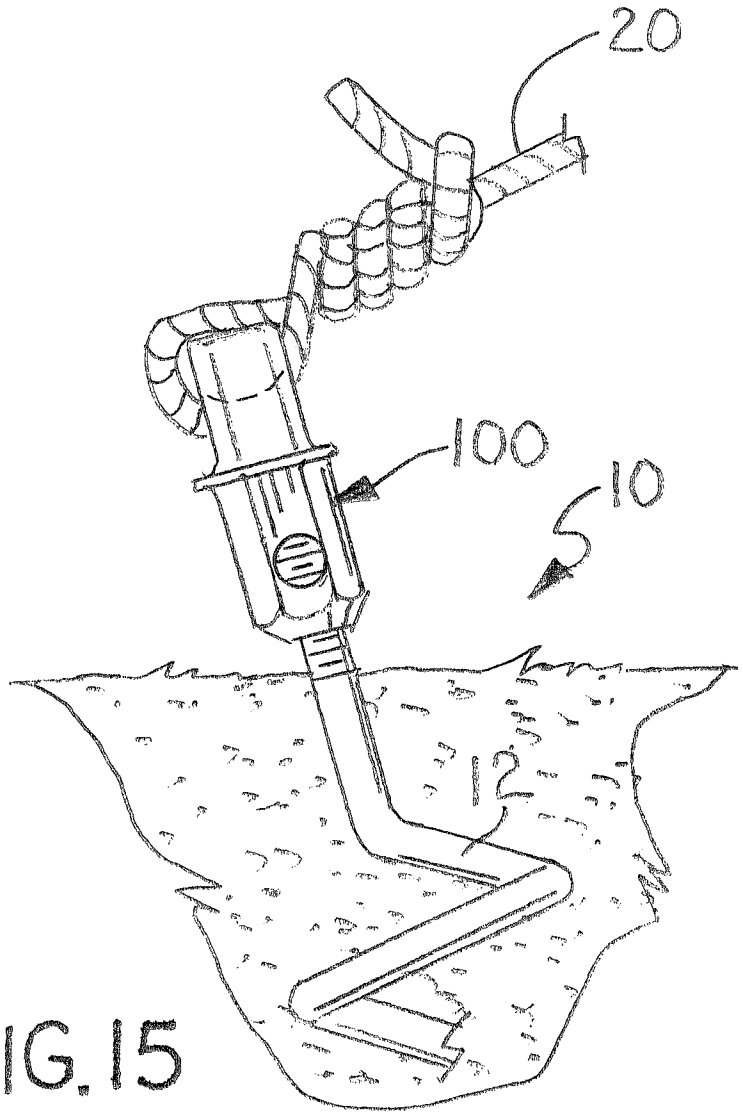
FIG. 15 is a side view of the anchor of FIG. 1 and guide wire.

In use, anchor head 100 allows conventional hand tools to be used to drive the anchor into the ground. A power drill/driver 50 and mating socket 52 can be applied to top section 110 to drive or withdraw anchor 10 into or from the ground (FIGS. 11 and 12). Similarly, a conventional open ended wrench (not shown) can be applied to either section 110 or 120 of anchor head 100 to rotate and drive anchor 10. Alternatively, a pry bar 60 can be inserted into bore 113 to facilitate rotating anchor 10 (FIGS. 13 and 14). Once anchor 10 is embedded in the ground, tethers and guide lines can be tied or fastened to anchor head 100 to secure other items and structures (FIGS. 15 and 16).

One skilled in the art will note several advantages to the anchor head of this invention. The anchor head allows conventional hand tools to be used to drive and remove spiral and helical blade style anchors. The anchor head also eliminates the need for the end of the anchor shaft to be bent into a handle so that the user can hand turn the anchor into the ground. The anchor head can be readily fitted to the threaded ends of a anchor shaft and permanently secured by swaging the shaft threads through a side bore in the anchor head. Swaging the threads provides a less costly and faster method for mounting the anchor head to the anchor shaft rather than simply welding the components together.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

We claim:

1. A Tie down ground anchor comprising:

an elongated shaft having a shaft end, the shaft end has helical threads; and an anchor head mounted to the shaft end, the anchor head having a first head section and a second head section integrally connected axially to the first head section, the first head section having first side walls configured to receive a first wrench or hex socket, the second head section having opposed second side walls configured to receive a second wrench or hex socket, the second head section having an axial bore therein, the axial bore has helical threads that mate with the helical threads of the shaft end, the second head section includes a lateral bore extending through the second side walls open into the axial bore thereof to receive a tool for deforming the helical threads of the shaft end.

2. The anchor of claim 1 wherein the first head section includes a lateral bore extending there through for receiving a tool or guide line.

3. The anchor of claim 1 wherein the first side walls having a first cross-sectional dimension, the second side walls having a second cross-sectional dimension.

4. The anchor of claim 3 wherein the first cross-sectional dimension is different than the second cross-sectional dimension.

5. The anchor of claim 1 wherein the first head section and the second head section are separated by an integral annular shoulder.

6. A tie down ground anchor comprising:

an elongated shaft having a shaft end, the shaft end has helical threads; and an anchor head mounted to the shaft end, the anchor head having a first head section and a second head section integrally connected axially to the first head section and separated by an annular shoulder, the first head section having first side walls configured to receive a first wrench or hex socket, the first head section includes a lateral bore extending there through for receiving a tool or guide line, the second head section having opposed second side walls configured to receive a second wrench or hex socket, the second head section having an axial bore therein, the shaft end seated within the axial bore, the axial bore has helical threads that mate with the helical threads of the shaft end, the second head section includes a lateral bore extending through the second side walls open into the axial bore thereof to receive a tool for deforming the helical threads of the shaft end, the first side walls having a first cross-sectional dimension, the second side walls having a second cross-sectional dimension, the first cross-sectional dimension is different than the second cross-sectional dimension.

* * * * *